United States Patent [19]

Hsu

[11] Patent Number: 5,050,054

[45] Date of Patent: Sep. 17, 1991

[54] ILLUMINATION APPARATUS ADJUSTING STRUCTURE

[76] Inventor: Angela Hsu, 1F, No. 8, Lane 313, Sec. 3 Chung Chin N. Rd., Taipei, Taiwan

[21] Appl. No.: 637,192

[22] Filed: Jan. 3, 1991

[51] Int. Cl.[5] ..... F21V 21/14

[52] U.S. Cl. ..... 362/285; 362/287; 362/413; 362/428; 362/401; 248/124

[58] Field of Search ..... 362/285, 287, 288, 401, 362/410, 413, 419, 427, 428; 248/124, 284, 281.1

[56] References Cited

U.S. PATENT DOCUMENTS

| | | | |
|---|---|---|---|
| 2,041,474 | 5/1936 | Kirschmann | 362/413 |
| 3,543,019 | 11/1970 | Jacobsen | 362/413 |
| 4,772,991 | 9/1988 | Wood | 362/287 |
| 4,847,740 | 7/1989 | Laske | 362/287 |
| 4,892,278 | 1/1990 | Huang | 362/285 |
| 4,928,217 | 5/1990 | Laske | 362/287 |
| 4,974,139 | 11/1990 | Chin-Song | 362/285 |
| 4,975,815 | 12/1990 | Lin | 362/287 |

*Primary Examiner*—Ira S. Lazarus

*Assistant Examiner*—D. M. Cox

*Attorney, Agent, or Firm*—Bucknam and Archer

[57] ABSTRACT

An illumination apparatus adjusting structure, comprising an adjustable lamp support mounted on a stand for holding a lamp holder. The adjustable lamp support comprises an invertedly disposed U-shaped balance rack mounted on a stand for holding an adjusting ring, a lamp supporting rod and a steering rod. The lamp supporting rod and the steering rod have each an end respectively connected to the lamp holder through a steering shaft. The opposite end of the steering rod is connected to the U-shaped balance rack at a lower end. The opposite end of the lamp supporting rod is inserted through the adjusting ring and coupled with a handhold. The adjusting ring has two symmetrical openings on the face thereof for inserting the lamp supporting rod, a plurality of rough, ridged surface portions bilaterally disposed by said openings for engaging a clamp in place which is used for securing the lamp supporting rod in position, and a center shaft held by two symmetrical side plates and fastened between the two unitary, parallel posts of the U-shaped balance rack.

1 Claim, 2 Drawing Sheets

ILLUMINATION APPARATUS ADJUSTING STRUCTURE

BACKGROUND OF THE INVENTION

The present invention relates to illumination apparatus, and more particularly to an illumination apparatus adjusting structure for adjusting the angle position of a lamp holder relative to a lamp stand.

Since the invention of electricity, a variety of illumination apparatus have been developed and used for giving light. When an illumination apparatus is used, it must be properly adjusted to focus its illumination on a certain area. In the various conventional illumination apparatus, the projecting angle of a lamp bulb is generally adjusted by connecting rods. Disadvantage of this adjusting structure is that the change of the angle position of a lamp bulb is confined to the moving range of the connecting rods. There is also disclosed a different type of working lamp adjusting structure, in which the angle position of the lamp holder is controlled by a balance rod matching with the weight change of the lamp holder. Disadvantage of this structure is that the whole structure is difficult to be accurately positioned at a balanced position. The present invention is designed to eliminate these problems. It is therefore an object of the present invention to provide an illumination apparatus adjusting structure which can be conveniently operated to fix a lamp holder at a desired angle position relative to the lamp stand.

DETAILED DESCRIPTION OF THE PREFERRED EMBODIMENT

Figure 1:
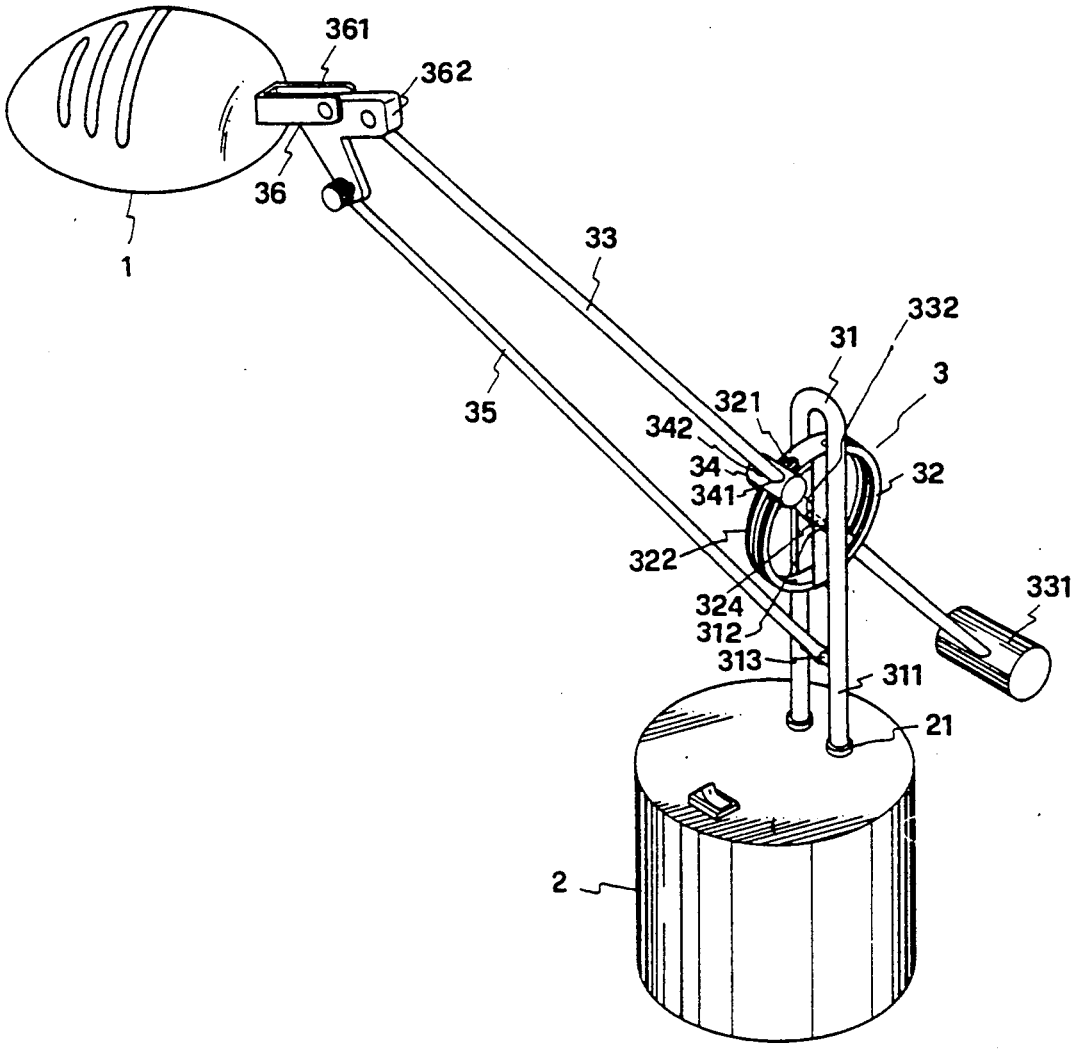
FIG. 1 is a perspective view of the preferred embodiment of the present invention.
Figure 2:
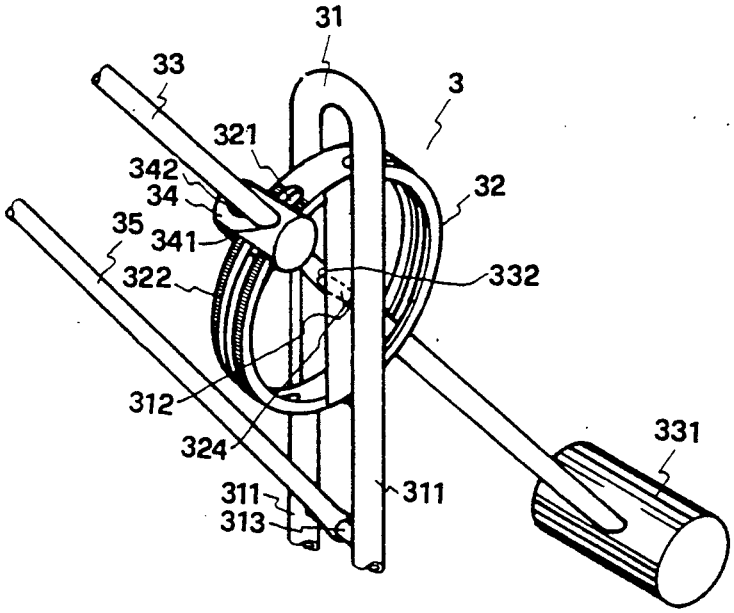
FIG. 2 is a schematic drawing illustrating the relative positioning of the balance rack, the adjusting ring, the clamp, the lamp supporting rod and the steering rod.

Referring to FIGS. 1 and 2, there is illustrated the preferred embodiment of the present invention which is generally comprised of a lamp holder 1, a stand 2 and an adjustable lamp support 3.

The lamp holder 1 is of the known art, having a lamp socket surrounded by a lamp shade for holding a lamp bulb.

The stand 2 is also of the known art, having a flat bottom suitable for mounting on a flat surface area, an internal circuit connected to a switch mounted thereon at the top, two mounting holes 21 at the top for mounting the adjustable lamp support 3. Further, the stand 2 must have certain weight sufficient for stably holding the adjustable support 3 and the lamp holder 1.

The adjustable lamp support 3 is generally comprised of a balance rack 31, an adjusting ring 32, a lamp supporting rod 33, a clamp 34, a steering rod 35, and a steering shaft 36. The balance rack 31 is comprised of an inverted U-rod having two opposite ends respectively fastened in the two mounting holes 21 of the stand 2. The two unitary, parallel posts 311 have each a opening 312 at the inner side for mounting the adjusting ring 32. A cross beam 313 is connected between the two unitary, parallel posts 311 at a lower position for holding the bottom end of the steering rod 35. The adjusting ring 32 comprises a plurality of openings 321 symmetrically made on the face thereof for inserting the lamp supporting rod 33, a plurality of rough, ridged surface portions 322 on the face thereof and bilaterally disposed by said openings 321 for engaging the clamp 34 in position, and a center shaft 324 held by two symmetrical side plates. The center shaft 324 has two opposite ends respectively fastened in the openings 312 of the two unitary, parallel posts 31 of the adjusting lamp support 3.

The clamp 34 is comprised of two opposite clamp plates integrally pivotably connected together, of which each has a retaining hole 341 for inserting the lamp supporting rod 33 and a bolt hole 342 for fastening into a clamped position.

The lamp supporting rod 33 is a hollow tube having holes at suitable locations for wiring. The outer diameter of the lamp supporting rod 33 is slightly smaller than the retaining holes 341 of the clamp 34 and the openings 321 of the adjusting ring 32. The lamp supporting rod 33 has one end (bottom end) inserted through the retaining holes 342 and the openings 321 and then coupled with a hand-hold 331, and an opposite end connected to the steering shaft 36. An opening 332 is made on the lamp supporting rod 33 at a suitable location for inserting the center shaft 324 of the adjusting ring 32, permitting the lamp supporting rod 33 to be rotated relative to the adjusting ring 32.

The steering rod 35 is relatively smaller than the lamp supporting rod 33, having one end connected to the cross beam 313 of the balance rack 31, and an opposite end coupled to the steering shaft 36.

The steering shaft 36 is comprised of a V-shaped steering rod 362 pivoted to a shaft 361 connected to the lamp shade of the lamp holder 1.

When in use, the hand-hold 331 is held in one's hand and rotated, causing the lamp supporting rod 33, the lamp holder 1 and the clamp 34 to make a motion relative to the adjusting ring 32, i.e. the clamp 34 is moved to slide along the opening 321 to which it is fastened. When applied force is released, the clamp 34 is engaged in place by the rough, ridged surface portions 322 of the adjusting ring 32. At the same time, the lamp shade of the lamp holder 1 is moved by the steering rod 362 to change its angle position.

It is to be understood that the drawings are designed for purposes of illustration only, and are not intended as a definition of the limits and scope of the invention disclosed.

What is claimed is:

1. An illumination apparatus adjusting structure, comprising:

a lamp holder having a lamp socket surrounded by a lamp shade for holding a lamp bulb;

a lamp stand having an electric circuit set therein, two mounting holes at the top;

an adjustable lamp support mounted on said mounting holes of said lamp stand for holding said lamp holder in a desired angle position; and characterized in that:

said adjustable lamp support is comprised of an invertedly disposed U-shaped balance rack, an adjusting ring, a lamp supporting rod, a clamp, a steering rod, and a steering shaft, said U-shaped balance rack comprising two unitary, parallel posts having each a hole made at the inner side, and a cross beam connected between said two unitary, parallel posts at a lower position, said adjusting ring having two symmetrical openings on the face thereof, a plurality of rough, ridged surface portions bilaterally disposed by said openings, a center shaft held by two symmetrical side plates, said center shaft having two opposite ends respectively fastened in said hole on each of said two unitary, parallel posts of said U-shaped balance rack, said clamp being clamped on one of said two symmetrical openings of said adjusting ring and having a retaining hole made thereon for inserting said lamp supporting rod, said lamp supporting rod having one end inserted through said retaining hole of said clamp and said symmetrical openings of said adjusting ring and then coupled with a hand-hold and an opposite end connected to said lamp holder via said steering shaft, said steering rod having one end connected to said cross beam of said balance rack and an opposite end coupled to said steering shaft.

* * * * *